US005434532A

United States Patent [19]

Thiel

[11] Patent Number: 5,434,532

[45] Date of Patent: Jul. 18, 1995

[54] LOW HEADROOM MANUFACTURABLE BANDGAP VOLTAGE REFERENCE

[75] Inventor: Frank L. Thiel, Richardson, Tex.

[73] Assignee: Texas Instruments Incorporated, Dallas, Tex.

[21] Appl. No.: 78,523

[22] Filed: Jun. 16, 1993

[51] Int. Cl.[6] ..... G05F 1/10; H01J 19/82

[52] U.S. Cl. ..... 327/531; 327/538; 327/542; 323/314; 323/316

[58] Field of Search ..... 323/313-316; 307/296.1, 296.6, 296.7; 327/531, 538, 542

[56] References Cited

U.S. PATENT DOCUMENTS

| | | | |
|---|---|---|---|
| 4,906,863 | 3/1990 | Van Tran | 323/313 |
| 5,120,994 | 6/1992 | Joly | 323/313 |
| 5,270,581 | 12/1993 | Nakamura | 323/313 |
| 5,325,045 | 6/1994 | Sundby | 323/313 |

*Primary Examiner*—Margaret Rose Wambach
*Attorney, Agent, or Firm*—Robby T. Holland; Wade James Brady, II; Richard L. Donaldson

[57] ABSTRACT

A voltage reference circuit (2) is provided that operates with a minimal amount of headroom. A low threshold voltage transistor (M71) is incorporated into a bandgap reference circuit (Q4, Q3, Q2, Q1, R2 and R1) to eliminate base current errors that a current mirror (Q3 and Q4) of the bandgap may introduce. A low threshold voltage transistor (M72) is incorporated into the gain circuit (Q7) to eliminate base current error that a gain transistor (Q7) may introduce. A third low voltage transistor (M73) may be incorporated into a feedback circuit (QS) to eliminate any voltage variations possibly caused by the addition of the first two low threshold transistors (M71 and M72). Using P channel type MOS low voltage threshold transistors for base drive cancellation allows the circuit to operate effectively with a very low input voltage of around about 2.0 volts. These CMOS low threshold devices absorb process variations in the transistors that may occur between different lots of silicon and thereby provide a more manufacturable voltage reference circuit.

11 Claims, 2 Drawing Sheets

LOW HEADROOM MANUFACTURABLE BANDGAP VOLTAGE REFERENCE

CROSS REFERENCE TO RELATED APPLICATIONS

This application is related to, and incorporates by reference, simultaneous co-filed and co-assigned Ser. No. 08/078,705, TI-17841, entitled "Second Order Curvature Corrected Bandgap Voltage Reference".

FIELD OF THE INVENTION

The invention is in the field of integrated circuits and more particularly relates to bandgap voltage reference circuits.

BACKGROUND OF THE INVENTION

Many integrated circuits require a stable reference voltage for operation. For example, reference voltages are used in data acquisition systems, voltage regulators, virtual grounds, measurement devices, analog-to-digital converters and digital-to-analog converters to name a few. U.S. Pat. No. 5,191,555 assigned to Texas Instruments Incorporated utilizes a reference voltage in a voltage regulator system for a dynamic random access memory, DRAM, application.

A buried-Zener reference is one way to produce a reference voltage. Another way to produce a reference voltage is with a bandgap voltage circuit. Bandgap voltage circuits can operate with a lower supply voltage than buried-Zener references and can also dissipate less power. The above U.S. Pat. No. 5,191,555 illustrates in FIG. 77 a bandgap circuit. Other bandgap reference circuits are illustrated in U.S. Pat. Nos. 5,168,209, 4,939,442, 4,906,863 and 4,362,984 all assigned to Texas Instruments Incorporated. Long term stability of a bandgap voltage reference exceeds that of a buried-Zener reference.

The operating voltage headroom of a voltage reference circuit effects how low the input supply can go before the voltage reference becomes inaccurate. For more accurate applications, generally, more headroom must be added to the circuit to allow additional transistors to be inserted. This, however, prevents conventional circuits from being used in low voltage applications. While the above U.S. Pat. No. 4,906,863 provides a wide-range power supply BiCMOS bandgap reference solution that is useful in low voltage conditions, additional improvements are needed. Process variance may cause the gains of bipolar transistors to vary, which may cause inaccuracies in the voltage reference that are not only dependent on operating conditions, but on the inherent properties of the semiconductor material itself.

It is an object of the invention to provide a voltage reference generator circuit that provides a stable reference over input power changes.

It is a further object of the invention to provide a voltage reference circuit that constantly sustains a reference low voltage applications.

It is a further object of the invention to provide a high performance bandgap reference circuit with almost no headroom loss.

It is an additional object of the invention to provide a voltage reference circuit that is less susceptible to process variances in bipolar transistors, thereby providing a more consistently manufacturable circuit.

Other objects and advantages will be apparent to those of ordinary skill in the art having reference to the following specification and drawings.

SUMMARY OF THE INVENTION

The operating headroom of a voltage reference circuit effects how low the input supply can go before the voltage reference becomes inaccurate. The voltage reference circuit according to the invention adds only about one more bipolar transistor's $V_{be}$ worth of headroom above the reference voltage itself, thus advantageously allowing the circuit to operate in low voltage conditions of around 2.0 volts. Using low voltage P channel MOS transistors in the voltage reference circuit accomplishes this. Such a device is added into a bandgap reference circuit to cancel base current error from the bandgap's current mirror. Another such device may be added to a gain circuit that is connected to the bandgap circuit to cancel base current error from the gain transistor. Another such device may be added in a feed back circuit that is connected to the bandgap and gain circuit to adjust for any voltage threshold variations of the first two devices. These low threshold PMOS devices collectively add the equivalent headroom of only about one bipolar transistor's base-emitter voltage above the output reference voltage. These devices additionally advantageously lower the effects of process variance in the gain of the bipolar transistors and thereby achieve a more consistently manufacturable circuit.

DETAILED DESCRIPTION OF THE PREFERRED EMBODIMENT

Figure 1:
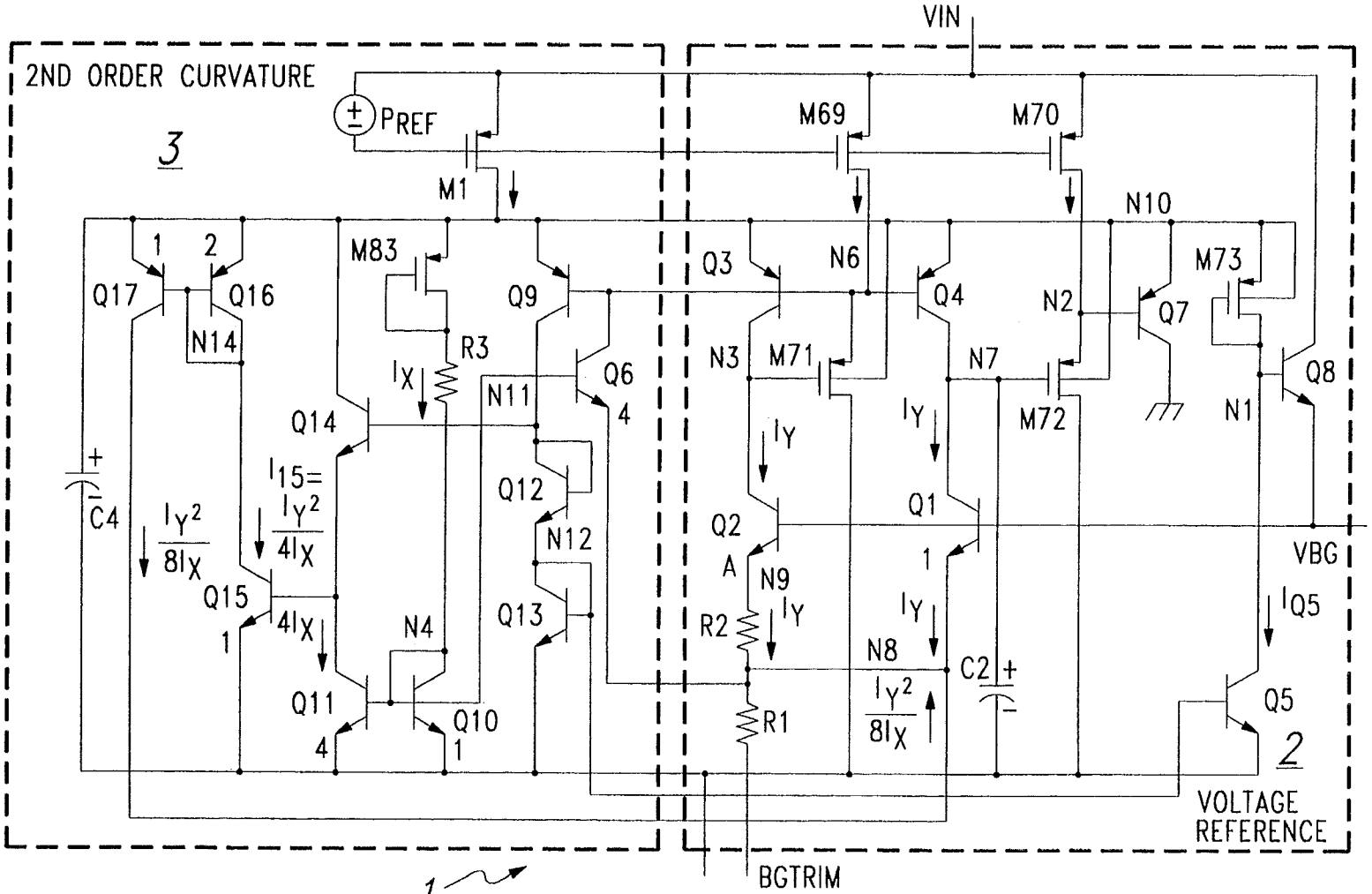
FIG. 1 is an electrical schematic diagram illustrating a voltage reference generator circuit incorporating a preferred embodiment of the invention.

FIG. 1 illustrates a voltage generator circuit 1. The voltage generator circuit includes a voltage reference circuit 2 and a 2nd order curvature correction circuit 3. The circuit receives an input voltage $V_{IN}$ and generates an output voltage $V_{BG}$. $V_{IN}$ could be any voltage within the range of process parameters. If the circuit is manufactured by a typical BiCMOS, bipolar and CMOS combined, process, $V_{IN}$ could be on the order of about 10 V, or higher if the process would allow. However, because of advantages that will be described later herein, the input voltage may be very low, such as on the order of about 2.5 volts. The circuit generates an output voltage $V_{BG}$ independent of the input voltage $V_{IN}$. The output voltage $V_{BG}$ is small, about 1.21 volts. The voltage PREF is not critical. It may be any constant voltage that will hold P channel MOS devices M1, M69, and M70 generating a constant amount of current. As will be explained later, essentially these devices are current sources.

In general with reference to following description, transistors M1, M69, M70, M71, M72, M73 and M83 are P-channel metal-oxide-semiconductor MOS transistors. In particular, transistors M71, M72, M73 and M83 are low voltage threshold, $V_t$, transistors. The other transistors are bipolar junction transistors.

With reference to voltage reference circuit 2 in FIG. 1, the collector of NPN transistor Q8 is connected to the input voltage $V_{IN}$ and the emitter of transistor Q8 is connected to the output voltage terminal $V_{BG}$. The base of transistor Q8 is connected to node N1. Low threshold voltage P channel MOS transistor M73 has its source connected to node N10 and its drain and gate connected to node N1. P channel MOS transistor M73 has a low threshold voltage, Vt. In the preferred embodiment, the threshold voltage is approximately −0.1 V. Transistor M73 is preferably a relatively small transistor and in the preferred embodiment, has a width of about 20 microns and a length of about 5 microns, which yields a gate-to-source voltage of about −0.2 volts. The use of this low threshold voltage transistor, along with others as described herein, advantageously provides for much higher performance with almost no headroom loss. Transistor M73 and transistor Q8 form a feedback source for voltage reference circuit 2 as will be later described.

In FIG. 1, NPN transistor Q5 is connected between node N1 and ground. The base of transistor Q5 is connected to node N12. Transistor Q5 forms a bias source for voltage reference circuit 2 as will be later described.

In voltage reference circuit 2 of FIG. 1, P channel MOS transistors M70 and M72 are connected in series between the input voltage $V_{IN}$ and ground. P channel MOS transistor M72 is a low threshold voltage transistor. The drain of transistor M70 and the source of transistor M72 are connected to the base of transistor Q7 at node N2. PNP transistor Q7 has its emitter connected to node N10 and its collector connected to the semiconductor substrate wherein voltage reference circuit 1 resides. The semiconductor substrate is tied to the circuit ground. Transistor Q7 and transistor M72 form a gain circuit for voltage reference circuit 2 as will be later described. Capacitor C2 is connected between the base of transistor M72 at node N7 and ground.

In FIG. 1, PNP transistor Q4 and NPN transistor Q1 are connected in series between node N10 and node N8. The collectors of transistors Q4 and Q1 are connected to the gate of transistor M72 at node N7. PNP transistor Q3 and NPN transistor Q2 are connected in series between node N10 and resistor R2. The base of transistor Q3 is connected to the base of transistor Q4 and the source of P channel MOS transistor M71 at node N6. P channel MOS transistor M71 is also a low threshold voltage transistor. The base of transistor Q2 is connected to the base of transistor Q1 and to the emitter of transistor Q8 at output voltage terminal $V_{BG}$. Transistors Q3 and Q4 preferably have their emitter ratios matched. The ratio of the emitter areas of transistor Q2 to Q1 is equal to "A". As will be explained later herein, in the preferred embodiment, transistor Q2 is about 8 times larger than transistor Q1 and so A equals eight. Resistor R2 is connected between the emitter of transistor Q2 and node N8. Resistor R1 is connected to resistor R2 at node N8 and is further connected to the terminal BGTRIM. Resistors R2 and R1 must be made of the same type of material, polysilicon for example, so that they have similar operating characteristics over a temperature range. The gate of transistor M71 is connected to the collector of transistor Q3 and the collector of transistor Q2 and node N3. Transistors Q3, Q4, M71, Q2 and Q1 along with resistors R2 and R1 form a bandgap reference circuit in voltage reference circuit 2 of FIG. 1 as will be described later herein.

P channel MOS transistor M69 is connected between the input voltage $V_{IN}$ and node N6. P channel MOS transistor M70 is connected between the input voltage $V_{IN}$, the source of transistor M72 and the base of transistor Q7 at node N2. Transistors M69 and M70 may be matched and need not be low threshold voltage transistors. The gates of transistors M69 and M70 are connected together and tied to the voltage reference PREF. Transistors M69 and M70 form current sources for voltage reference circuit 2 of FIG. 1 as will be described later herein.

In FIG. 1, however now with respect to 2nd order curvature correction circuit 3, PNP transistor Q9 and NPN transistors Q12 and Q13 are connected in series between node N10 and ground. The base of transistor Q9 is connected to the collector of transistor Q6 and to the base of transistor Q3 at node N6. The collector of transistor Q9 is connected to the collector and base of transistor Q12 at node N11. Transistor Q9 may be about the same size as transistors Q3 and Q4. The emitter of transistor Q12 and the collector and base of transistor Q13 are connected together at node N12. Transistor Q9 forms a current $I_Y$ generator for 2nd order curvature correction circuit 3 of FIG. 1.

In FIG. 1, NPN transistor Q6 has its collector connected to the base of transistors Q9, Q3, and Q4 at node N6. The emitter of transistor Q6 is connected to resistors R2 and R1 and the emitter of transistor Q1 at node N8. As will be explained later, transistor Q6 forms a startup generator for voltage reference circuit 2.

With reference to 2nd order curvature correction circuit 3 of FIG. 1, low threshold voltage P channel MOS transistor M83, resistor R3 and NPN transistor Q10 are connected in series between node N10 and ground. The gate and drain of transistor M83 are connected to resistor R3 while the source of transistor M83 is connected to node N10. Resistor R3 is preferably of the same type of material as resistors R2 and R1 so that it has similar operating characteristics over the temperature range. Transistor M83 and resistor R3 form a current $I_X$ generator for 2nd order curvature correction circuit 3 as will be explained later herein.

In FIG. 1, the collector and base of transistor Q10 are connected to transistor R3 at node N4. The base of transistor Q6 is also connected to node N4. NPN transistors Q14 and Q11 are connected in series between node N10 and ground. The base of transistor Q14 is connected to node N11. The base of transistor Q11 is connected to node N4. Transistors Q11 and Q10 form a current mirror in 2nd order curvature correction circuit 3. Transistor Q11 is preferably larger than transistor Q10, its emitter area being about 4 times that of transistor Q10.

In the 2nd order curvature correction circuit 3 of FIG. 1, PNP transistor Q16 and NPN transistor Q15 are connected in series between node N10 and ground. The base and collector of transistor Q16 are connected together at node N14. The base of transistor Q15 is connected to the emitter of transistor Q14 and the collector of transistor Q11 at node N13. PNP transistor Q17 is connected between node 10 and node 8. The base of transistor Q17 is connected to node N14. As will be explained later herein, transistors Q17 and Q16 form a current mirror. The ratio of the transistors is such that transistor Q16 is about twice as big as transistor Q17. Capacitor C4 is connected between node N10 and ground.

In 2nd order curvature correction circuit 3 of FIG. 1, transistors Q15, Q14, Q13, Q12, Q11 and Q10 form a translinear mathematical cell. It is commonly referred to as a Gilbert multiplier, or Gilbert squarer. Its function will be described later herein. The translinear squarer could additionally be constructed of MOS, bipolar or PNP transistors.

In FIG. 1, MOS P-channel transistor M1 is connected between the input voltage $V_{IN}$ and node N10. The gate of transistor M1 is connected to the input voltage PREF. Like MOS transistors M69 and M70, MOS transistor M1 need not be a low threshold voltage transistor. Transistor M1 forms a current source for 2nd order curvature correction circuit 3 and voltage reference circuit 2 of FIG. 1.

Figure 2:
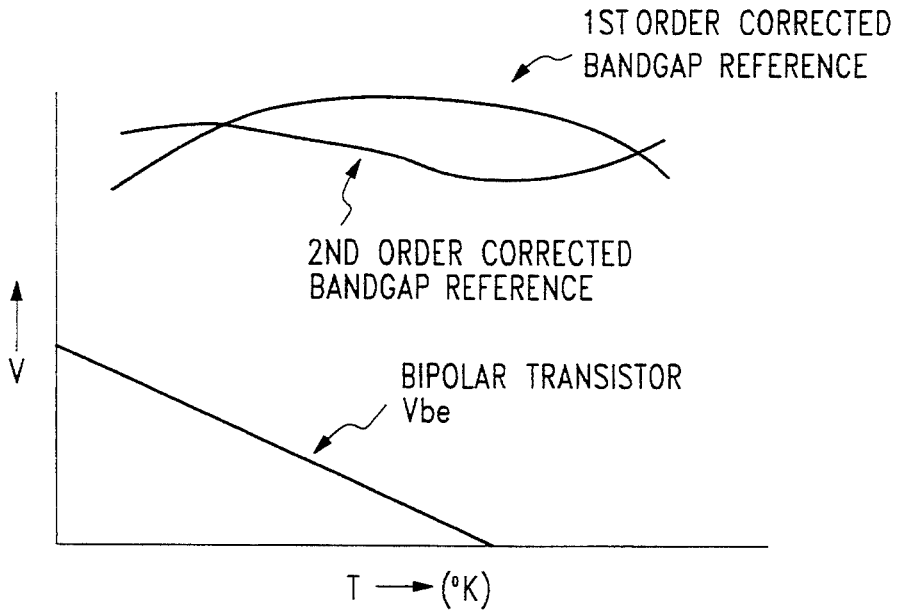
FIG. 2 is a graph showing $V_{be}$ temperature characteristics of a bandgap circuit.

Before turning to the functional operating characteristics of voltage reference circuit 2 and 2nd order curvature correction circuit 3 of FIG. 1, a general description of temperature dependency is provided with reference to FIG. 2.

FIG. 2 depicts $V_{be}$ voltage over temperature. $V_{be}$ may represent the uncorrected voltage across the base-emitter junction of transistor Q1 of FIG. 1, for example (assuming the other advantageous devices were not present). The voltage $V_{be}$ will greatly deviate by decreasing over the temperature range as temperature increases. This would make an inaccurate voltage reference if it were used alone. The goal is to have a voltage that is stable over the temperature range.

One way to enhance stability is by using a first-order corrected bandgap reference circuit. In FIG. 1, the bandgap reference circuit formed by devices Q3, Q4, Q2, Q1, R2 and R1 is a first-order corrected bandgap circuit. (It is additionally improved, however, by the addition of transistor M71 as will be described later.) FIG. 2 shows that the voltage of a first-order corrected bandgap looks parabolic over temperature when compared to the uncorrected $V_{be}$. The first-order corrected bandgap voltage is derived by forcing a current with a positive temperature dependency through a resistor, developing a voltage equal to IR. The $V_{be}$, itself, which has a negative temperature coefficient and the IR which has a positive temperature coefficient are tentatively balanced so that the temperature coefficients cancel each other out, thereby tending to generate a composite voltage that is stabilized over temperature.

The following mathematical equations show how the first-order corrected circuit cancels temperature dependency. The temperature dependence of a $V_{BE}$ can be expressed as a polynomial series:

$$V_{BE}(T)=a+bT+cT^2+$$

With respect to FIG. 1, and assuming 1) forward bias on the base-emitter junctions of $Q_1$ and $Q_2$; 2) that base current is negligible; and 3) that $I_Y$ is accurately mirrored, the output voltage is provided by:

$$V_{BG}=V_{be1}+2I_yR_1$$

Since $I_y$ is formed by the differential base-emitter voltages of matched devices $Q_1$ and $Q_2$, $I_Y$ is provided by:

$$I_y=\left(\frac{n_fkT}{q}\right)\ln(A)/R_2$$

Substituting for $I_Y$ and rewriting the expression for $V_{BG}$ yields:

$$V_{BG}=V_{be1}+\left(\frac{2n_F\,k\ln A}{q}\right)\left(\frac{R_1}{R_2}\right)T$$

Since $R_1$ and $R_2$ are made of the same material, their temperature dependencies cancel, making $R_1/R_2$ a constant with respect to temperature. The other multipliers in front of T are also constants and therefore combinable into a single constant:

$$g\equiv\frac{2n_F\,k\ln(A)\,R_1}{qR_2}$$

The above equation relies upon device physics constants such as: Boltzmann's constant (k) of $1.38062\times10^{-23}$ J/.K; an electron charge (q) of $1.60219\times10^{-19}$ C; and, base-emitter emission coefficient ($n_F$) of $Q_1$ and $Q_2$.

Therefore, the output voltage equation is provided by:

$$V_{BG}(T)=gT+a+bT+cT^2$$

In this equation, g is chosen to be equal to (−b) by adjusting A, $R_1$ and $R_2$ thereby cancelling the first order term, and leaving:

$$V_{BG}(T)=a+cT^2+$$

Again, the resulting improved first-order corrected bandgap voltage curve, as compared to $V_{be}$, is illustrated in FIG. 2.

Continuing with reference to FIG. 2, a 2nd order corrected bandgap voltage provides greater voltage stability over a 1st order corrected circuit. The second order curvature corrected voltage curve has an approximately sinusoidal temperature dependency. The uncorrected $V_{be}$ deviates hundreds of millivolts across the temperature range of around 200 degrees celsius. Numerically, this variance would yield approximately 0.6 V deviation. A first order corrected bandgap may yield approximately 50 mV or less variance across the temperature range. Advantageously, a 2nd order corrected bandgap may yield about 5 mV or less variance across the temperature range.

Briefly, and before explaining in detail the functional operation of 2nd order curvature correction circuit 3 of FIG. 1, 2nd order curvature correction circuit 3 is added to cancel out the 2nd order term of the bandgap reference circuit that affects temperature stability. In mathematical representation, the 2nd order curvature correction circuit adds another term to the bandgap voltage series expansion:

$$V_{BG}(T)=pT^2+a+cT^2$$

where p is chosen to be equal to (−c) and cancels that term. Hence, by modeling the bandgap voltage as a polynomial expression and canceling out the most important temperature factors, the first and second order terms, a more stable reference voltage is provided.

The silicon bandgap voltage reference circuit 2 cancels out the first order term that has a linear dependence on temperature. The bandgap cancels out the first order by using a resistor ratio. It generates a current that is proportional to temperature. This current is fed through a resistor ratio to generate a voltage that increases with temperature approximately the same amount that the voltage $V_{be}$ decreases with temperature, thereby canceling out the first order linear term. The 2nd order circuit 3 connected to the silicon bandgap circuit 2 develops a term that is proportional to temperature squared and cancels out the second order temperature squared term of the bandgap. The 2nd order circuitry is based upon a mathematical squaring function and cancels out the second order term. The 2nd order curvature correction circuit thus generates a current that goes up with temperature squared and which is fed into the bandgap to cancel the next, 2nd, term in the equation.

A detailed explanation of the temperature cancelling operation of 2nd order curvature correction circuit 3 of FIG. 1 is now provided. Transistors Q3 and Q4 are matched and form a current mirror. Q3 is the reference side. A certain amount of current $I_y$, flows through Q2, and is pulled from Q3 where it is reflected to node N7. This forces transistors Q1 and Q2 to be running with the same amount of current. Q2's emitter area is larger than that of Q1, about eight times the size in the preferred embodiment.

By summing the currents flowing into N8, and therefore through $R_1$, (assuming $Q_6$ is effectively switched off), we can define the voltage at N8 and add this to $V_{be1}$ to arrive at $V_{BG}$. The output voltage $V_{BG}$ is represented by:

$$V_{BG} = 2\,I_y R_1 + \frac{I_{y2}}{8\,I_x} R_1 + V_{be1}$$

$V_{be1}$, the voltage across transistor Q1, is represented as:

$$V_{be1} = \frac{n_F kT}{q} \ln\left(\frac{I_y}{I_S}\right) \quad \text{assuming forward bias}$$

$V_{be2}$, the voltage across transistor Q2, is represented as:

$$V_{be2} = \frac{n_F kT}{q} \ln\left(\frac{I_y}{AI_S}\right)$$

This equation assumes forward bias of transistor Q2. The constant "A" represents the emitter area variance of transistor Q2 over transistor Q1; that is, A represents the emitter area ratio Q2/Q1. In the preferred embodiment, A equals 8 as transistor Q2 is eight times larger than transistor Q1.

Assuming matched collector currents, the current $I_Y$ flows through both transistor Q1 and Q2 is given as:

$$I_y = \frac{V_{be1} - V_{be2}}{R_2} = \frac{n_F kT \ln A}{qR_2}$$

where A is the emitter area ratio of $Q_2$ to $Q_1$.

The current $I_X$, flowing through resistor R3 is given as:

$$I_x = \frac{V_{BG} + V_{be8} - V_{be10} + V_{gs73} - V_{gs83}}{R_3} \approx \frac{V_{BG}}{R_3}$$

Using device physics constants, the current $I_S$ can be written as:

$$I_S = CT^m e^{-q\frac{V_{go}}{(kT \cdot nF)}}$$

Now, assuming very little resistor temperature variation, such as is the case if low temperature coefficient polysilicon resistors are used, a constant coefficient G is defined as:

$$\text{Let } G \equiv \frac{n_F k \ln A}{qR_2}$$

Rewriting the equation for the output voltage $V_{BG}$ by substituting the constant "G" and the expression for $I_X$ yields:

$$V_{BG} = 2GR_1 T + \frac{n_F kT}{q} \ln\left[\frac{I_y}{CT^m e^{[-q\frac{V_{go}}{(kT \cdot nF)}]}}\right] + R_1 \frac{I_{y2} R_3}{8\,V_{BG}}$$

Simplifying the equation by substituting for $I_Y$ above gives:

$$V_{BG} = 2\,GR_1\,T + \frac{n_F kT}{q} \ln\left(\frac{GT}{CT^m}\right) + V_{go} + \frac{R_1 R_3 G^2}{8\,V_{BG}} T^2$$

Again, simplifying the above equation provides:

$$V_{BG}(T) = 2\,GR_1\,T + \frac{n_F kT}{q}\left(\ln\frac{G}{C} + (1-m)\ln T\right) + V_{go} + \frac{R_1 R_3 G^2}{8\,V_{BG}} T^2$$

The above equation is about in the form of the Taylor series expansion given previously for a 2nd order curvature corrected bandgap:

$$V = gT + pT^2 + a + bT + cT^2$$

where $V_{go}$ provides most of the "a" constant;

$$\frac{n_F k \ln\frac{G}{C}}{q}$$

provides most of the "b" coefficient to T; an expansion of (1−m) ln T provides the "c" coefficient and contributes some to the "a" and "b" terms (this can be shown by doing a series expansion of the ln term); "g" is provided by $2GR_1$; and, "p" is provided by:

$$\frac{R_1 R_3 G^2}{8\,V_{BG}}$$

(assuming that $V_{BG}$ and the resistors have little temperature dependence.)

By setting the first derivative of the bandgap voltage with respect to temperature equal to zero, the conditions necessary to cancel the first order temperature dependency can be derived. This first derivative is given by:

$$V_{BG}' = 2\,GR_1 + \frac{n_F kT}{q}\left[(1-m)\frac{1}{T}\right] + \frac{n_F k}{q}\left[\ln\frac{G}{C} + (1-m)\ln T\right] + \frac{R_1R_3G^2}{4\,V_{BG}}\,T$$

Simplifying the above equation gives:

$$V_{BG} = 2\,GR_1 + \frac{n_F k}{q}\left[(1-m)(1+\ln T) + \ln\frac{G}{C}\right] + \frac{R_1R_3G^2}{4\,V_{BG}}\,T$$

Taking the derivative of the above equation (the 2nd order derivative) provides:

$$V_{BG}'' = \frac{n_F k\,(1-m)}{qT} + \frac{R_1R_3G^2}{4\,V_{BG}}$$

This equation allows the second order term to be canceled and set to zero as follows below, thus cancelling the temperature effects caused by that term.

As there still exist a temperature term in the 2nd order derivative, no 2nd order temperature effects can be guaranteed at only one temperature designated as $To_2$. Therefore, setting the derivative equal to zero at that temperature provides:

$$V_{BG}''(T_{o2}) = 0 \quad \therefore \frac{R_1R_3G^2}{4\,V_{BG}} = \frac{n_F k\,(m-1)}{q\,T_{o2}}$$

This equation provides an expression for the resistors in terms of constants, the goal being to determine the resistor values necessary to set the equation up and make it mathematically and physically valid.

Now, the above value for the second order differential $V_{BG}''$ is substituted into the first order differential $V_{BG}'$ and, likewise, setting $V_{BG}'=0$ at some other temperature $T_{o1}$ provides an expression for the resistor $R_1$ as:

$$V_{BG}(T_{o1}) = 2\,GR_1 + \frac{n_F k}{q}\left[(1-m)(\ln T_{o1}+1) + \ln\frac{G}{C}\right] + \frac{n_F kT_{o1}\,(m-1)}{q\,T_{o2}}$$

$$2\,GR_1 = \frac{n_F k}{q}\left[(m-1)\left(1+\ln T_{o1} - \frac{T_{o1}}{T_{o2}}\right) - \ln\frac{G}{C}\right]$$

Substituting the above into the equation for $V_{BG}$ yields:

$$V_{BG}(T) = \frac{n_F kT}{q}\left[(m-1)\left(1+\ln T_{o1} - \frac{T_{o1}}{T_{o2}}\right) - \ln\frac{G}{C}\right] + \frac{n_F kT}{q}$$

-continued $$\left[\ln\frac{G}{C} + (1-m)\ln T\right] + V_{go} + \frac{n_F k\,(m-1)}{2\,q\,T_{o2}}\,T^2$$

Simplifying allows the bandgap voltage to be written without any dependency on the resistor values:

$$V_{BG}(T) = \frac{n_F kT}{q}(m-1)\left(1 - \frac{T_{o1}}{T_{o2}} - \ln\frac{T}{T_{o1}} + \frac{T}{2\,T_{o2}}\right) + V_{go}$$

In this equation $V_{go}$, m and $n_F$ are specific to the process and the device types. In the embodiment illustrated in FIG. 1, they are NPN transistor parameters where $n_F$ is the base-emitter emission coefficient, m is the temperature exponent of the device leakage current, and $V_{go}$ is the energy gap of the device at zero degrees kelvin.

Since transistor Q9 is also matched to transistors Q3 and Q4, a current equal to $T_Y$ also passes through transistor Q9 towards transistors Q12 and Q13. The voltage at node N11 is given as:

$$V_{N11} = V_{be12} + V_{be13}$$

The voltage at node N11 is also given as:

$$V_{N11} = V_{be14} + V_{be15}$$

Using the same equation as before:

$$V_{be12} = \frac{n_F kT}{q}\ln\left(\frac{I_{12}}{I_S}\right)$$

and rewriting the equation in terms of the above expressions provides:

$$\left[\ln\left(\frac{I_{12}}{I_S}\right) + \ln\left(\frac{I_{13}}{I_S}\right)\right] = \left[\ln\frac{I_{14}}{I_S} + \ln\frac{I_{15}}{I_S}\right]$$

This equation assumes the matching component devices. That is, the devices should act like each other as they are laid out next to each other in the silicon and their properties should be about the same. The Iand $n_F$ characteristics for the NPN transistors are the same, so they are constants.

Canceling and using the multiplying of natural logs gives:

$$\ln\left[\frac{I_{12}\cdot I_{13}}{I_S^2}\right] = \ln\left[\frac{I_{14}\cdot I_{15}}{I_S^2}\right]$$

Solving the equation in terms of $I_{15}$ provides:

$$I_{15} = \left(\frac{I_{12}\cdot I_{13}}{I_{14}}\right)$$

$I_{15}$ is the current generated by the translinear circuit comprised of devices Q15, Q14, Q12 and Q13. As the continuing equations will show, the Gilbert cell squarer feeds into the voltage reference circuit, through the current mirror of transistors Q16 and Q17, and generates a term that cancels the temperature dependent term in the equation. It produces a current proportional to temperature squared that cancels out the 2nd order term. It provides a voltage at node N8 that cancels out the variations of the $V_{be}$ of transistor Q1.

The currents $I_{12}$ and $I_{13}$ are equal and equal to the current $I_Y$. $I_{14}$ is forced by the current mirror comprised of transistors Q11 and Q10. The current through transistor Q10 is $I_X$. Since transistor Q11 is four times larger than transistor Q10, the current out of transistor Q11 is $4I_X$. Therefore, equals $4I_X$. So, the current $I_{15}$ equals $I_Y^2/4I_X$.

The current through transistor Q17 equals $I_Y^2/8I_X$. This is because transistor Q15 feeds its current into transistor Q16, which is double the size of transistor Q17; therefore, the collector current coming out of transistor Q17 is one half of the current coming out of transistor Q16. This current is fed into the bandgap at node N8.

It is desirable that the current at node N8 have a component proportional to temperature squared:

$$I \alpha T^2$$

$I_Y$ (previously derived) is:

$$Iy = GT$$

G is the constant previously derived.

Assuming that resistor R3 has virtually no temperature dependence:

$$\text{Assume } \frac{dR_3}{dT} \approx 0$$

$$\frac{dR_2}{dT} \approx 0$$

The current $I_X$ has very little temperature dependence. Now, solving for $I_Y^2$:

$$I_Y^2 = G^2T^2$$

This equation provides a term for $I_Y^2$ with a dependence proportional to temperature squared.

Finally, placing the term $G^2/8I_X$ as a constant, yields:

$$I_{2nd\text{-}order} = \frac{I_y^2}{8\,I_x} = p \cdot T^2$$

The 2nd order canceling term is fed into node N8 of FIG.1. Node N8 is the bandgap voltage $V_{BG}$ minus the $V_{be}$ of transistor Q1. Node N8 is thus the $V_{be}$ canceling node. Since $V_{be1}$ wants to decrease over a rising temperature, the voltage at node N8 needs to be increasing the same amount over an increasing temperature. Without the connection to the collector of transistor Q17 at node N8, the voltage reference circuit 1 would cancel out only the first order temperature term and only a first order bandgap would be provided.

In summary with reference to 2nd order curvature correction circuit 3 of FIG. 1, the bandgap circuit 2 cancels out the first order term by using a resistor ratio. It generates a current, $2I_Y$, that is proportional to temperature. This current is fed through resistor R1 to generate a voltage that increases with temperature approximately the same amount that the voltage $V_{be}$ decreases with temperature, thereby canceling out the linear term. The 2nd order curvature correction circuit advantageously feeds a current, $I_Y^2/8I_X$, that goes up with temperature squared, into the bandgap that cancels out the $cT^2$ second order equation term.

Turning to voltage reference circuit 2 of FIG. 1, a detailed functional description is now provided.

In general, and as will be explained in more particular detail, voltage reference circuit 2 of FIG. 1 solves the problem of operating a voltage reference circuit with a low input supply. By adding only about one more transistor's worth of headroom above the reference itself, the circuit may advantageously operate with a low input voltage of between the range of about 2.0–2.5 volts. The use of very low threshold voltage, $V_t$, P channel MOS devices additionally provides high performance with virtually no headroom loss. (Headroom typically understood by those of ordinary skill in the art as defining some minimal amount of input voltage necessary in order for the circuit to work.) Using low threshold voltage P channel MOS base drive cancellation devices substantially lowers the effects of semiconductor process variance in the gain of the bipolar transistors, achieving a more consistently manufacturable circuit.

Transistors M1, M69 and M70 are merely current sources. Other devices could be used. Transistor Q6 helps start up the voltage reference circuit. A problem with bandgaps is that sometimes they may not turn on when power is applied to $V_{IN}$. Transistor Q6 forces current to be pulled and thereby forces the bandgap reference to initially turn on. Thereafter, transistor Q6 turns off.

In FIG. 1, the bandgap reference circuit formed by devices Q3, Q4, Q2, Q1, R2 and R1 is operating at very low currents. Base current errors may be introduced by transistors Q3, Q9, Q7 and Q4 into the $I_Y$ current coming out of transistor Q2. P channel low threshold transistors M71 and M72 help eliminate these base current errors. Generally, PMOS transistor M71 cancels the base current of the current mirror formed by transistors Q9, Q3 and Q4. PMOS transistor M72 cancels the base current caused by the gain transistor Q7. PMOS transistor M73 adjust for threshold voltage variations in transistors M71 and M72 and gives them the headroom to operate.

In FIG. 1, if transistors M71 and M72 did not exist, the circuit could be modeled by shorting their gates to their sources. The potential base current error caused by Q9, Q3 and Q4 flowing into node N3 would make an inaccuracy in $I_Y$. This error is not as large, however, as the potential base current error caused by transistor Q7. Essentially, any current from current source M1 that is not used to bias the transistors in the voltage reference and 2nd order curvature correction circuit must be dumped by transistor Q7. Its purpose is to dump any excess current and exactly the right amount of excess current to keep voltage $V_{BG}$ regulated. Its possible base drive current error could be substantial, sometimes 20% to 30% of $I_Y$.

In voltage reference circuit 2 of FIG. 1, P channel transistor low threshold voltage M72 eliminates any base drive error caused by transistor Q7 thereby providing an improved gain circuit. The base current of transistor Q7 flows through transistor M72 into ground. Since M72 has no gate current, there is no current error created in Q1 and Q4. If there is very little base drive out of transistor Q7, transistor M72 will be almost off. The current source of transistor M70 guarantees that there is always some amount of current flowing through transistor M72 to keep it stable.

Another potential problem is that there may be a large voltage difference, called early voltage mismatch, between the collectors of transistors Q3 and Q4 or transistors Q2 and Q1. The currents may not be exactly $I_Y$ in each. The transistor M72 forces the voltage at node N7 to sit at about the voltage of node N6, which happens to be about where node N3 is sitting, thereby advantageously canceling any early voltage effects. This helps the circuit to work at a very low headroom.

In voltage reference circuit 2 of FIG. 1, similarly with transistor M71, transistor M69 provides a bias current. Transistor M71 eliminates any potential base current error caused by transistors Q9, Q3 and Q4. Transistor M71 is likewise a low threshold voltage PMOS device having no gate current. The base current of transistors Q9, Q3 and Q4 flow through transistor M71 to ground. Transistor M71 therefore provides an improved bandgap reference circuit.

An overall goal of voltage reference circuit 2 of FIG. 1 is to have the voltage $V_{IN}$ be as close to the voltage $V_{BG}$ as possible. Ideally, the circuit would need no more input voltage than that of the output voltage $V_{BG}$ of about 1.21 volts. In actuality, the circuit gets close. It approaches a $V_{be}$ of transistor Q8. At room temperature, transistor Q8 will have a $V_{be}$ of about 0.6 volts. A typical PMOS device will have a threshold voltage of about 1 volt. Using such a device would require a substantial increase in headroom. This would prevent the circuit from effectively being utilized in low voltage applications, such as about 3.3 volts. However, the low threshold voltage PMOS devices used in the circuit have turn on voltages of around about 0.1 volts. They advantageously keep the headroom voltage low by adding only approximately 0.2 to 0.3 volts to the circuit. The input voltage may be in the range of about 2.0 to 2.5 volts.

Voltage reference circuit 2 of FIG. 1 is reproducible over processing. If the gain of transistors Q7, Q3 and Q4 varies over different processing lots, M72 and M71 can absorb all the variations, thereby making a much more reliable performing part.

A description of the feedback source formed by transistors M73 and Q8 of FIG. 1 is now provided. If transistor Q8 were connected directly to node N10, there would be only the $V_{be}$ of transistor Q8, about 0.6 volts, between $V_{BG}$ and node N10 for transistors Q3 and Q4 to operate. Transistors Q3 and Q4 need a $V_{be}$ just to get down to their bases. If their collectors were forced to be much higher than their bases, they would saturate and be nonlinear, making an inaccurate circuit. The threshold voltage of transistor M71 could possible vary, due to processing limitations. But, advantageously, another device (transistor M73) is added that will move this rail up or down the exact same amount that transistor M71 could vary over processing. This gives transistors Q4, Q3, Q2 and Q1 headroom so that they do not saturate. If transistors Q3 and Q4 turn out with about 2 or 3 tenths of a volt $V_t$, M73 will move the voltage at node N10 the exact same amount that transistors Q3 and Q4 move up, therefore, transistors Q3 and Q4 will not have any headroom problems.

Restating the above few paragraphs with reference to transistors M71, M72 and M73, in voltage reference circuit 2 of FIG. 1, there is essentially only a $V_{be}$ across the $V_{BG}$ node N10 rail: $V_{be8}$ plus $V_{gsM73}$. $V_{gsM73}$ approximately 0.2 volts, (which is essentially 0 volts). Transistor M73 is added to counteract transistors M71 and M72. Transistor M71 is added to give base drive to transistors Q3, Q4 and Q9. Transistor M72 is added to give base drive to transistor Q7. Transistors Q3 and Q4 need to have a certain amount of base drive to set the current $I_Y$. If the Betas of transistors Q3 and Q4 were very high, normally one would tie node N6 to node N3. However, when the Betas are lower, this will cause base current error. Since there is no gate current on a MOS device, transistor M71 cancels all the error. Similarly, transistor Q7 forms an emitter follower that allows the bandgap to adjust itself to varying conditions and keep a constant voltage. It has base current. P channel MOS transistor M72 provides enhanced base current drive to transistor Q7 without adding base current error. This yields an incredibly high precision matched circuit.

In voltage reference circuit 2 of FIG. 1, transistor Q5 is a bias source. It does the same thing for transistor M73 that transistors M69 and M70 do for M71 and M72. It queues up an amount of current, $I_{Q5}$ through the device. The current $I_{Q5}$ should be much greater than the current into the base of transistor Q8. It is known how much current is going through transistor M73. It is known what the transistor width to length ratio for transistor M73 is (width=20; length=5 in the preferred embodiment) so the offset voltage of transistor M73 can be calculated. Conversely, it is known what the value of current $I_X$ is, so M83 can be ratioed to that. That is, transistors M73 and M83 may have about the same voltage drop. They effectively cancel each other. Transistor M83 cancels out the effects of transistor M73 across the resistor R3 so that current $I_X$ can be more accurately generated. The size of transistor M83 is proportionally bigger than transistor M73 in the same proportion that the current $I_X$ is bigger than the collector current $I_{Q5}$.

The benefits provided by voltage reference circuit 2 of FIG. 1 are many, and in contrast to traditional approaches. One traditional approach would be to add a bipolar device to cancel the unwanted base drive. This, however, adds one more transistor $V_{be}$ worth of headroom to the bandgap reference circuit (approximately 0.4 V to 1.0 V). If a MOS device were used, its $V_t$ would generally add a comparable amount of headroom that a bipolar device would add. However, by using a P channel MOS with a near 0 V Vt, the benefits of base drive cancellation are added with virtually no additional headroom. Another traditional approach would be to use mirror circuits that attempt to add an equivalent amount of parasitic current to both sides of the bandgap reference circuit to compensate for the control current of the bipolar device. However, such a mirroring scheme would inherently add its own errors.

The PMOS devices have virtually no DC control current requirements and thus eliminate a potentially added error. The control currents needed for a bipolar device create an error in the regulation of a stable voltage value at the output of the reference circuit. This error is dependent on the gain of the bipolar devices, which varies significantly from lot to lot of silicon wafers, making a less manufacturable device. Since the P channel devices significantly eliminate the error caused by control current requirements, it is not as critical that the gain of the bipolar devices not vary as substantially across lots. More variance in the bipolar devices is acceptable. Thus, voltage reference circuit 2 provides a more manufacturable device by allowing for additional errors in the gain of the bipolar devices. Since almost no headroom is added by the PMOS device, low voltage circuit operation is maintained.

Almost any product that needs to cancel parasitic control currents could use the technique of canceling current errors through the addition of PMOS devices. This is particularly well suited to BiCMOS applications, where low Vt PMOS devices can cancel unwanted base drive of the bipolar devices. Thus, a broad spectrum of integrated circuits, including modern linear circuits from voltage references to power drivers to amplifiers, could obtain the benefits described herein.

While the invention has been described with reference to illustrative embodiments, this description is not intended to be construed in a limiting sense. Various other embodiments of the invention will be apparent to persons skilled in the art upon reference to this description. For example, it will be apparent that by reversing device types, low threshold voltage N channel NMOS devices could be used. It is therefore contemplated that the appended claims will cover any such modifications of the embodiments as fall within the true scope and spirit of the invention.

What is claimed is:

1. An improved bandgap reference circuit, comprising:

a bandgap reference circuit having a first bipolar transistor in a first current leg and a second bipolar transistor in a second current leg, bases of the first and second bipolar transistor being connected together; and a low threshold P channel transistor having a threshold voltage of about −0.1 volts and having its gate connected to the first current leg Of the bandgap reference circuit and having its source connected to the bases of the first and second bipolar transistors.

2. The improved bandgap reference circuit of claim 1 additionally comprising:

a gain circuit connected to the bandgap reference circuit, the gain circuit including a low threshold voltage P channel transistor having a threshold voltage of about −0.1 volts and having its gate connected to the second current leg of the bandgap reference circuit.

3. The improved bandgap reference circuit of claim 2 additionally comprising:

a feedback circuit connected to the bandgap reference circuit and connected to the gain circuit, the feedback circuit including a low threshold voltage P channel transistor having a threshold voltage of about −0.1 volts.

4. A voltage reference circuit, comprising:

a bandgap reference circuit having a current mirror formed of a first current leg having a first bipolar transistor and a second current leg having a second bipolar transistor the base of the first bipolar transistor and the base of the second bipolar transistor being connected together;

a gain transistor connected to the bandgap reference circuit; and a first low threshold voltage P channel transistor having a threshold voltage of around −0.1 volts connected to the gain transistor and having its gate connected to the second bipolar transistor of the second current leg to eliminate base current error that the gain transistor may introduce.

5. The voltage reference circuit of claim 4 additionally comprising:

a second low threshold voltage P channel transistor having a threshold voltage of around −0.1 volts and having its gate connected to the first bipolar transistor of the first current leg and its source connected to the bases of the first and second bipolar transistors of the bandgap reference circuit to eliminate base current error that the current mirror may introduce.

6. The voltage reference circuit of claim 5 additionally comprising:

a third low threshold voltage P channel transistor having a threshold voltage of about −0.1 volts to adjust for voltage threshold variations in the first and second low threshold voltage P channel transistors.

7. The voltage reference circuit of claim 6 further comprising:

a first current bias source connected to the first low threshold voltage P channel transistor; and a second current bias source connected to the second low threshold voltage P channel transistor.

8. The voltage reference circuit of claim 7 wherein P channel transistors form the first current bias source and the second current bias source.

9. The voltage reference circuit of claim 8 further comprising:

a third current bias source connected to the third P channel low threshold voltage transistor.

10. The voltage reference circuit of claim 9 wherein a bipolar transistor forms the third current bias source.

11. The voltage reference circuit of claim 10 further comprising:

a second bipolar transistor connected to the bandgap reference circuit to initialize the bandgap reference circuit.

* * * * *